US006445140B2

(12) United States Patent
Buij et al.

(10) Patent No.: US 6,445,140 B2
(45) Date of Patent: Sep. 3, 2002

(54) CIRCUIT DEVICE

(75) Inventors: Arnold Willem Buij; Marcel Beij; Machiel Antonius Martinus Hendrix; Wilhelmus Hinderikus Maria Langeslag, all of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/883,428

(22) Filed: Jun. 18, 2001

(30) Foreign Application Priority Data

Jun. 20, 2000 (EP) ..... 00202145

(51) Int. Cl.[7] ..... H05B 37/02

(52) U.S. Cl. ..... 315/291; 315/209 R; 315/224; 315/360

(58) Field of Search ..... 315/209 R, 224, 315/244, 291, 360, DIG. 2, DIG. 4, DIG. 5, DIG. 7; 363/34, 37

(56) References Cited

U.S. PATENT DOCUMENTS 5,670,849 A * 9/1997 Melai ..... 315/209 R
6,078,147 A * 6/2000 Arts et al. ..... 315/209 R
6,084,361 A * 7/2000 Wacyk ..... 315/209 R
6,333,605 B1 * 12/2001 Grouev et al. ..... 315/194

* cited by examiner

*Primary Examiner*—Don Wong
*Assistant Examiner*—Thuy Vinh Tran

(57) ABSTRACT

A lamp is operated by means of a DC-AC converter provided with switches and generating an AC current at a high frequency. In each half period of the lamp current, the voltage across the lamp is reversed during an adjustable time interval. The lamp can be dimmed without instabilities by adjusting the time interval.

6 Claims, 2 Drawing Sheets

CIRCUIT DEVICE

BACKGROUND OF INVENTION

The invention relates to a circuit device for supplying an alternating current of frequency f to a lamp, which circuit device is provided with a DC-AC converter comprising

- input terminals for connecting the circuit device to a supply voltage source supplying a DC voltage,
- a first branch including a series arrangement of a first switching element and a second switching element,
- a control circuit coupled to respective control electrodes of the switching elements for rendering the switching elements conducting and non-conducting,
- a load branch shunting one of the switching elements and provided with a series arrangement of an inductive element and terminals for accommodating the lamp.

Such a circuit device is disclosed in EP 0323676. In such a circuit device, the power consumed by the lamp can be adjusted, for example, by adjusting the frequency f of the control signal. A drawback of this way of adjusting the power consumed by the lamp resides in that the connection between the frequency of the control signal and the power consumed by the lamp is not unambiguous throughout the range of power consumed by the lamp. Particularly in the case of a comparatively low power consumption by the lamp, this may give rise to instabilities in the lamp operation. Another possibility of adjusting the power consumed by the lamp is to adjust the periods during which the switching elements are conducting in each period of the control signal, while the frequency of the control signal remains constant. This can be carried out symmetrically, which means that each one of the switching elements is conducting during an equal period of time in each period of the control signal. However, this can also be carried out asymmetrically, which means that the time interval during which the first switching element is conducting is unequal, in each period of the control signal, to the time interval during which the second switching element is conducting. In addition, a distinction can be made between a situation wherein one of the switching elements is conducting at any instant in a period of the control signal (apart from the very short time interval during which the conducting switching element is rendered non-conducting and the non-conducting switching element is rendered conducting), and a situation wherein there are time intervals during which neither switching element is conducting. In practice it has been found that asymmetrically driving the switching elements gives rise, for certain unpredictable values of power consumed by the lamp, to instabilities in the lamp. If the switching elements are symmetrically driven, a reduction of the duration during which each of the switching elements is conducting in a period of the control signal means that, during each period of the control signal, there are time intervals wherein both switching elements are non-conducting. It has been found that this way of driving the switching elements also gives rise to instabilities in the lamp, however, the values of power consumed by the lamp are predictable.

SUMMARY OF THE INVENTION

It is an object of the invention to provide a circuit device by means of which the power consumed by the lamp can be adjusted in a comparatively large range without instabilities developing in the lamp.

To achieve this, a circuit device as mentioned in the opening paragraph is characterized in accordance with the invention in that the control circuit generates a control signal at a frequency f during operation of the lamp,

- for rendering the first switching element, in each first half period of the control signal, successively conducting, non-conducting and conducting during, respectively, a first, a second and a third time interval, the second switching element always being conducting when the first switching element is non-conducting, and non-conducting when the first switching element is conducting, and
- for rendering the second switching element, in each second half period of the control signal, successively conducting, non-conducting and conducting during, respectively, a fourth, a fifth and a sixth time interval, the first switching element always being conducting when the second switching element is non-conducting, and non-conducting when the second switching element is conducting, and
- in that the control circuit is further provided with a dimming circuit for setting the duration of the second and the fifth time interval.

During operation of a circuit device in accordance with the invention, the control signal renders the switching elements alternately conducting and non-conducting. During each first half period of the control signal, the current in the load branch and hence also the current through the lamp has an average value measured in a first polarization direction. During each second half period of the control signal, the current in the load branch and hence also the current through the lamp has an average value measured in a second polarization direction. As a result, an AC current of frequency f flows in the load branch. Apart from the very short time interval during which, in succession, the conducting switching element is rendered non-conducting and the non-conducting switching element is rendered conducting, one of the switching elements is conducting at any instant of a period of the control signal. When the duration of the second time interval and the duration of the fifth time interval are both zero, the power consumed by the lamp is maximal and one of the switching elements is continuously conducting during each half period of the control signal. If the dimming circuit sets the duration of the second time interval and the duration of the fifth time interval at a value that is not equal to zero, the form of the voltage across the load branch is changed such that the amplitude of the fundamental harmonic term of this voltage (the term of frequency f) decreases. As a result, also the power consumed by the load branch and the power consumed by the lamp decrease. The amplitude of the fundamental harmonic term of the voltage across the load branch decreases further as the second and the fifth time interval last longer. As a result, also the power consumed by the lamp decreases. The lowest power consumption by the lamp can be set by making the duration of both the second time interval and the fifth time interval equal to $\frac{1}{6}T$, where T is the duration of a period of the control signal. It has been found that a circuit device in accordance with the invention enables the power consumed by the lamp to be adjusted in a comparatively large range without instabilities developing in the lamp.

Satisfactory results have been achieved with embodiments of a circuit device in accordance with the invention, wherein the duration of the second time interval is equal to the duration of the fifth time interval. The second and the fifth time interval can be made adjustable in a range from zero to $\frac{1}{6}T$, as described hereinabove, where T is the duration of a period of the control signal. However, it is alternatively possible to make the second and the fifth time interval adjustable in a range from ⅙T to ½T. In the latter case, the power consumed by the lamp is maximal if the second and the fifth time interval both have a duration equal to ½T.

In a first preferred embodiment of a circuit device in accordance with the invention, $\Delta t1/\Delta t3=1$ and $\Delta t4/\Delta t6=1$ for each adjustable value of $\Delta t2$ and $\Delta t5$, where $\Delta t1-\Delta t6$ are the durations of, respectively, the first to the sixth time interval. As the second and the fifth time interval are in the middle of, respectively, the first half period and the second half period of the control signal, the durations of the second and the fifth time interval can be set in a large range.

In a second preferred embodiment of a circuit device in accordance with the invention, the dimming circuit is additionally provided with a circuit part FT for setting the point in time at which the second time interval begins within each first half period of the control signal, and for setting the point in time at which the fifth time interval begins within each second half period of the control signal. It has been found that, at predetermined durations of the second time interval and the fifth time interval, the power consumption by the lamp depends to a small degree on the points in time at which these time intervals begin in successive half periods. The circuit part FT thus enables the power consumption by the lamp to be very accurately adjusted.

BRIEF DESCRIPTION OF THE DRAWINGS

These and other aspects of the invention will be apparent from and elucidated with reference to the embodiment(s) described hereinafter.

In the drawings.

DESCRIPTION OF THE PREFERRED EMBODIMENTS

Figure 1:
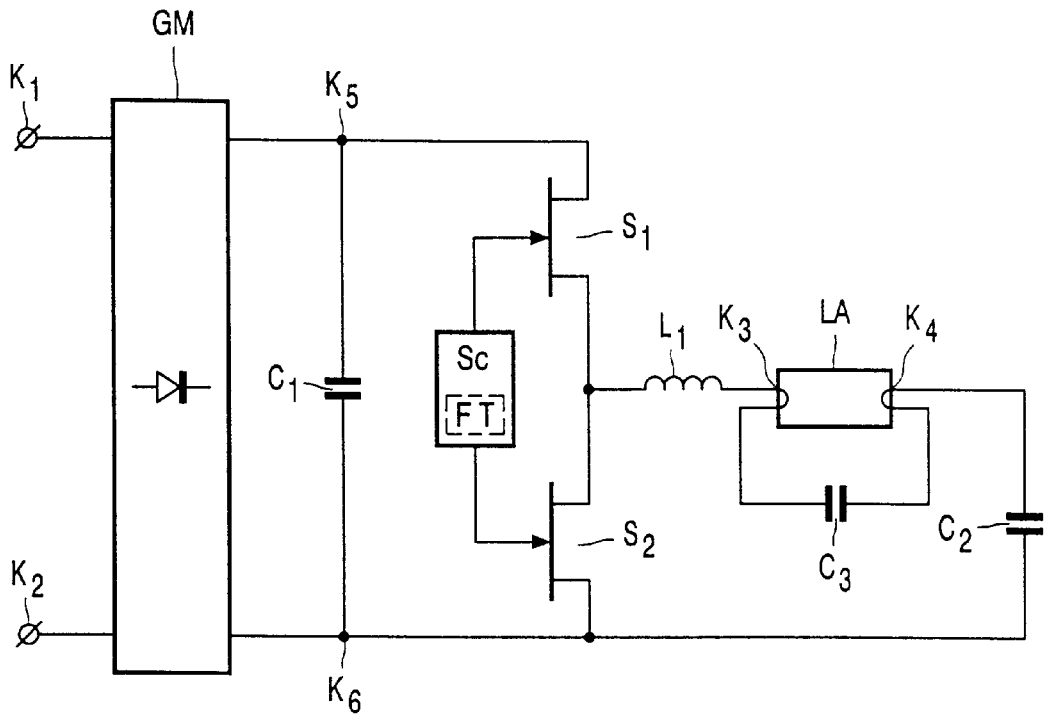
FIG. 1 diagrammatically shows an example of a circuit device in accordance with the invention.

In FIG. 1, K1 and K2 denote terminals which are to be connected to a supply voltage source supplying a low-frequency AC voltage. Terminals K1 and K2 are connected to respective inputs of rectifier means GM, which are formed by a diode bridge. Respective outputs of the rectifier means GM are connected to input terminals K5 and K6 which are to be connected to a supply voltage source supplying a DC voltage. Input terminals K5 and K6 are connected to each other by means of a capacitor C1, which is a buffer capacitor. The supply voltage source supplying a DC voltage is formed, in this example, by the supply voltage source supplying an AC voltage, terminals K1 and K2, rectifier means GM and capacitor C1. Capacitor C1 is shunted by a series arrangement of a first switching element S1 and a second switching element S2. This series arrangement forms a first branch in this example. Sc is a control circuit for generating, during operation of the lamp, a control signal at a frequency f for rendering the first switching element, in each first half period of the control signal, successively conducting, non-conducting and conducting during, respectively, a first, a second and a third time interval, the second switching element always being conducting when the first switching element is non-conducting, and non-conducting when the first switching element is conducting, and for rendering the second switching element, in each second half period of the control signal, successively conducting, non-conducting and conducting during, respectively, a fourth, a fifth and a sixth time interval, the first switching element always being conducting when the second switching element is non-conducting, and non-conducting when the second switching element is conducting. The control circuit Sc is further provided with a dimming circuit for setting the durations of the second and the fifth time interval and comprises a circuit part FT for setting the point in time at which the second time interval begins within each first half period of the control signal, and for setting the point in time at which the fifth time interval begins within each second half period of the control signal. Respective outputs of control circuit Sc are connected to respective control electrodes of the switching elements. Switching element S2 is shunted by a load branch formed by a series arrangement of coil L, terminal K3, capacitor C3, terminal K4 and capacitor C2. Terminals K3 and K4 are terminals for accommodating a lamp. A lamp La is connected to these terminals. Coil L forms an inductive element in this example.

The operation of the example shown in FIG. 1 is as follows.

Figure 2A:
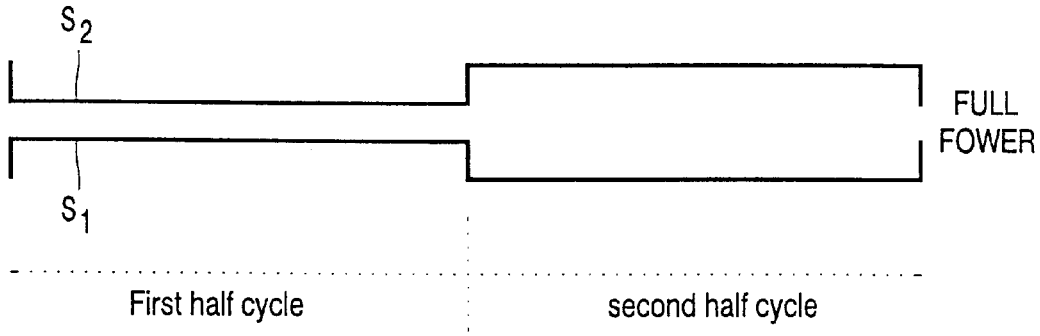
FIGS. 2A and 2B show the form of the control signal generated by a control circuit forming part of the circuit device shown in FIG. 1, and FIG. 3 and FIG. 4 show the power consumed by a lamp that is energized by a circuit device in accordance with FIG. 1, as a function of the durations of the second and the fifth time interval.
Figure 2B:
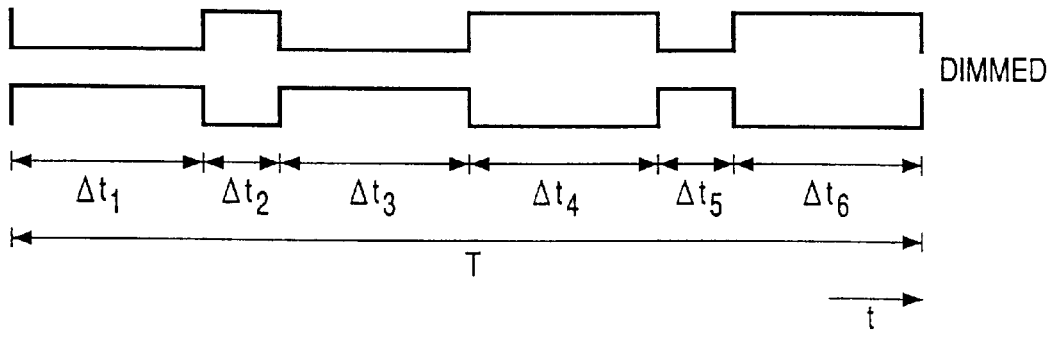

If terminals K1 and K2 are connected to the poles of a supply voltage source supplying a low-frequency AC voltage, then this low-frequency AC voltage is rectified by the rectifier means GM, and a DC voltage is applied across capacitor C1 and hence also between input terminals K5 and K6. The control circuit Sc generates a control signal at a frequency f for rendering each of the switching elements alternately conducting and nonconducting. If the power consumed by the lamp is maximal, the control signal is formed as indicated in FIG. 2A. This Figure shows that the duration of a period of the control signal is T and that the control signal renders the switching elements S1 and S2 conducting during a period of time which is equal to approximately ½T, and, at any point in time, only one of the switching elements is conducting. If the power consumption by the lamp is set so as to be below the maximum value, the form of the control signal is as indicated in FIG. 2B. This Figure shows that the period T of the control signal is now divided into six successive time intervals, which are indicated in FIG. 2B as $\Delta t1-\Delta t6$. During each of these time intervals, one of the switching elements is conducting and the other switching element is non-conducting. The duration of the second and the fifth time interval can be set between zero and ⅙T by a user of the circuit device. The second half period of the control signal is equal to the inverted first half period. During the second time interval $\Delta t2$, the voltage across the series arrangement of coil L and lamp La is contrary to the voltage across this series arrangement during the first time interval 66 t1 and the third time interval $\Delta t3$. Also during the fifth time interval $\Delta t5$, the voltage across the series arrangement of coil L and lamp La is contrary to the voltage across this series arrangement during the fourth time interval $\Delta t4$ and the sixth time interval $\Delta t6$. As a result, the amplitude of the fundamental harmonic term of the voltage across the load branch decreases. Consequently, also the power consumed by the load branch and the power consumed by a lamp decrease. By increasing the duration of the second and the fifth time interval to ⅙T, the power consumed by the lamp can be reduced. It is to be noted that, if $\Delta t1/\Delta t3=1$, $\Delta t4/\Delta t6=1$, $\Delta t2=\frac{1}{6}T$ and $\Delta t5=\frac{1}{6}T$, the control signal is symmetrical and its frequency is equal to 3*f. If the second and the fifth time interval are equal to ⅙T, then the power consumed by the lamp is minimal. In other words, each value of the power consumed by the lamp can be adjusted if the second and the fifth time interval can be adjusted between zero and ⅙T. However, it is also possible to set each value of the power consumed by the lamp by setting the second and the fifth time interval in the range between ⅙T and ½T.

To adjust the power consumed by the lamp, use can alternatively be made of the circuit part FT by setting the point in time at which the second time interval begins within each first half period of the control signal, and by setting the point in time at which the fifth time interval begins within each second half period of the control signal. The presence of the circuit part FT enables the power consumed by the lamp to be accurately set.

Figure 3:
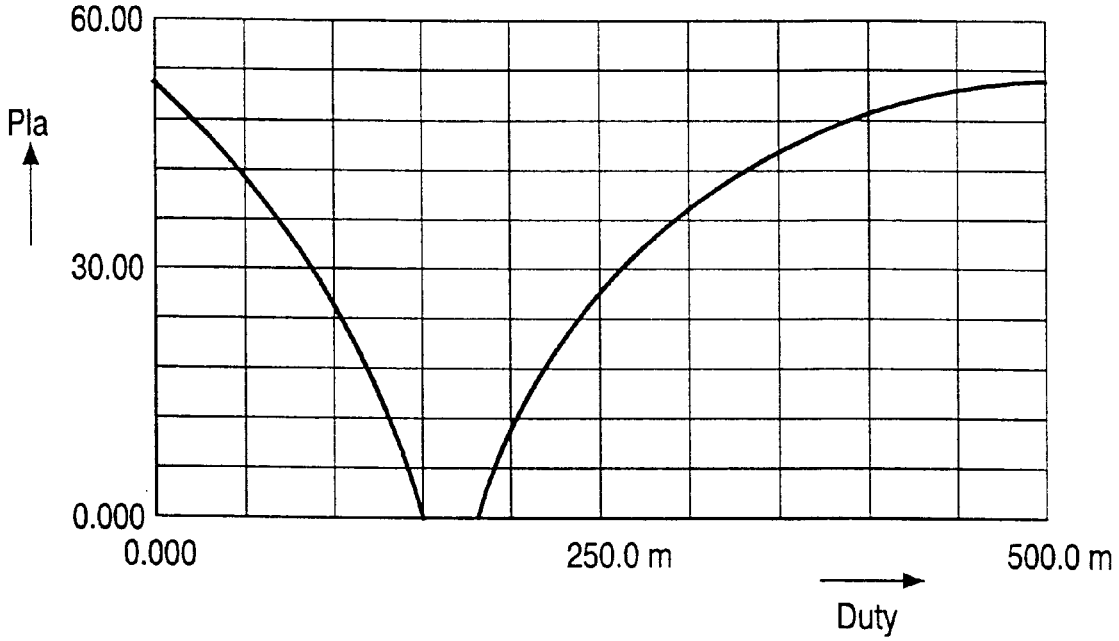

A concrete embodiment of a switching device, as shown in FIG. 1, was used to energize a low-pressure mercury vapor discharge lamp of the type TLD (Philips) having a rated power of 58 watt. The frequency f of the control signal and hence also the lamp current were 56 kHz. During operation, the voltage between input terminals K5 and K6 was approximately 410 V. The capacitances of capacitors C2 and C3 were, respectively, 220 nF and 6800 nF. The induction value of coil L1 was 1100 mH. Along the horizontal axis in FIG. 3 and FIG. 4, time is plotted in units equal to 0.001T, where T is equal to the duration of a period of the control signal. The power consumed by the lamp in watts is plotted along the vertical axis. FIG. 3 shows the power consumed by the lamp as a function of the durations of the second and the fifth time interval. These durations are chosen to be equal throughout the range. The second time interval is symmetrical about the point in time t=¼T, where T is equal to the duration of a period of the control signal. The fifth time interval is symmetrical about the point in time t=¾T.

Figure 4:
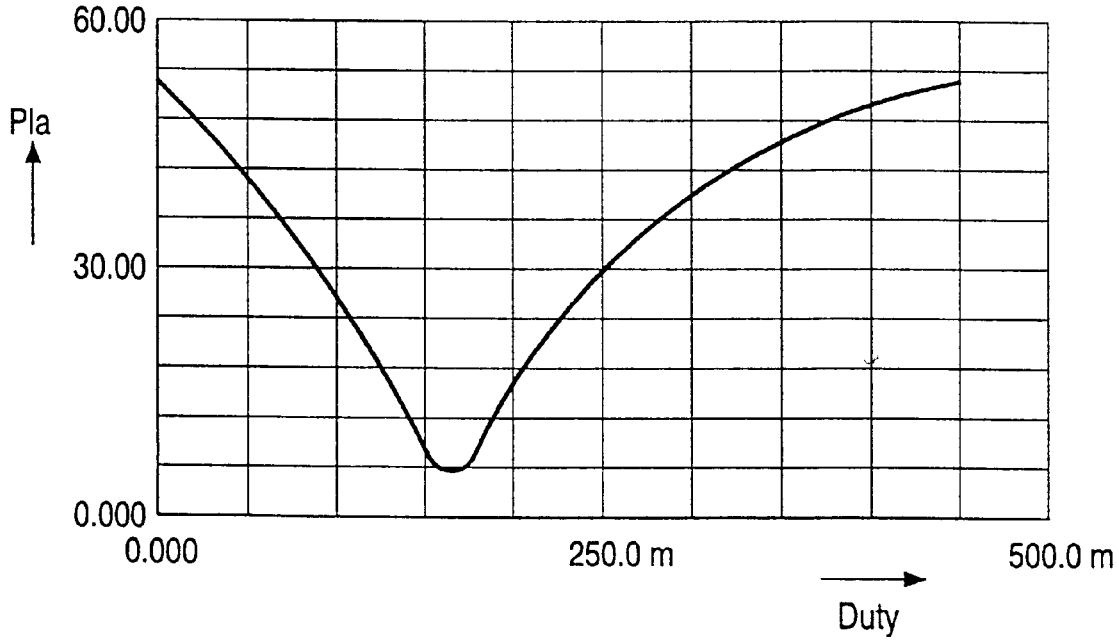

FIG. 4 shows the power consumed by the lamp if the second time interval is symmetrical about the point in time t=0.23T and the fifth time interval is symmetrical about the point in time t=0.73T. In other words, the points in time at which the second and the fifth time interval begin are different from the situation shown in FIG. 3. Apart from that, the control signal is equal to the control signal yielding the results shown in FIG. 3. In FIG. 3 as well as in FIG. 4, the minimum value of the lamp power is reached if both the second and the fifth time interval are equal to ⅙T. This minimum value is higher in FIG. 4 than in FIG. 3, however. FIG. 3 and FIG. 4 illustrate that a circuit device in accordance with the invention enables the power consumed by the lamp to be adjusted in a very large range. By setting the point in time at which the second time interval begins and the point in time at which the fifth time interval begins, it is also possible to accurately set the power consumed by the lamp.

What is claimed is:

1. A circuit device for supplying an alternating current of frequency f to a lamp, which circuit device is provided with a DC-AC converter comprising input terminals for connecting the circuit device to a supply voltage source supplying a DC voltage, a first branch including a series arrangement of a first switching element and a second switching element, a control circuit coupled to respective control electrodes of the switching elements for rendering the switching elements conducting and non-conducting, a load branch shunting one of the switching elements and provided with a series arrangement of an inductive element and terminals for accommodating the lamp, characterized in that the control circuit generates a control signal at a frequency f during operation of the lamp, for rendering the first switching element, in each first half period of the control signal, successively conducting, non-conducting and conducting during, respectively, a first, a second and a third time interval, the second switching element always being conducting when the first switching element is non-conducting, and non-conducting when the first switching element is conducting, and for rendering the second switching element, in each second half period of the control signal, successively conducting, non-conducting and conducting during, respectively, a fourth, a fifth and a sixth time interval, the first switching element always being conducting when the second switching element is non-conducting, and non-conducting when the second switching element is conducting, and in that the control circuit is further provided with a dimming circuit for setting the duration of the second and the fifth time interval.

2. A circuit device as claimed in claim 1, wherein the duration of the second time interval is equal to the duration of the fifth time interval.

3. A circuit device as claimed in claim 2, wherein the second and the fifth time interval can be adjusted in a range from zero to ⅙T, where T is the duration of a period of the control signal.

4. A circuit device as claimed in claim 2, wherein the second and the fifth time interval can be adjusted in a range from ⅙T to ½T.

5. A circuit device as claimed in claim 1, wherein $\Delta t1/\Delta t3=1$ and $\Delta t4/\Delta t6=1$ for each adjustable value of $\Delta t2$ and $\Delta t5$, where $\Delta t1-\Delta t6$ are, respectively, the durations of the first to the sixth time interval.

6. A circuit device as claimed in claim 1, wherein the dimming circuit is also provided with a circuit part for setting the point in time at which the second time interval begins within each first half period of the control signal, and for setting the point in time at which the fifth time interval begins within each second half period of the control signal.

* * * * *